US008154496B2

(12) United States Patent
Yamagata et al.

(10) Patent No.: US 8,154,496 B2
(45) Date of Patent: Apr. 10, 2012

(54) LIQUID CRYSTAL DISPLAY DRIVE CIRCUIT

(75) Inventors: Yoshiyuki Yamagata, Gunma (JP); Tetsuya Tokunaga, Gunma (JP); Yasuo Osawa, Gunma (JP); Kensuke Goto, Ashikaga (JP)

(73) Assignees: SANYO Semiconductor Co., Ltd., Gunma (JP); Semiconductor Components Industries, LLC, Phoenix, AZ (US)

( * ) Notice: Subject to any disclaimer, the term of this patent is extended or adjusted under 35 U.S.C. 154(b) by 709 days.

(21) Appl. No.: 12/274,645

(22) Filed: Nov. 20, 2008

(65) Prior Publication Data

US 2009/0140969 A1 Jun. 4, 2009

(30) Foreign Application Priority Data

Nov. 28, 2007 (JP) ..... 2007-307331

(51) Int. Cl.
*G09G 3/36* (2006.01)

(52) U.S. Cl. ..... 345/98

(58) Field of Classification Search ..... 345/100, 345/98

See application file for complete search history.

(56) References Cited

FOREIGN PATENT DOCUMENTS

JP 7-319418 12/1995

OTHER PUBLICATIONS

"LCD Driver IC PT6530" [Online] Feb. 2006, The European Search Report mailed Feb. 23, 2009.*

European Search Report directed towards a counterpart foreign application mailed Feb. 23, 2009; (2 pages).

"LCD Driver IC PT6530" [Online] Feb. 2006, The European Search Report mailed Feb. 23, 2009; (48 pages).

* cited by examiner

*Primary Examiner* — Quan-Zhen Wang
*Assistant Examiner* — Nelson D Runkle, III
(74) *Attorney, Agent, or Firm* — Morrison & Foerster LLP

(57) ABSTRACT

This invention offers an LCD drive circuit that prevents conversion to a wrong duty driving state and an unintended display caused by taking in of serial data corresponding to the wrong duty driving state. The LCD drive circuit is provided with an LCD drive signal generation circuit that generates driving signals to turn LCD segments on and off based on serial data received by a serial data receiving circuit and is switchable between a ¼ duty driving state and a ⅓ duty driving state. The LCD drive circuit is also provided with a driving state setting circuit that sets the LCD drive signal generation circuit to the ¼ duty driving state based on identification data when the serial data receiving circuit receives the serial data corresponding to the ¼ duty driving state and thereafter forbids the LCD drive signal generation circuit to take in serial data corresponding to the ⅓ duty driving state when the serial data receiving circuit receives the serial data corresponding to the ⅓ duty driving state.

16 Claims, 10 Drawing Sheets

LIQUID CRYSTAL DISPLAY DRIVE CIRCUIT

CROSS-REFERENCE OF THE INVENTION

This application claims priority from Japanese Patent Application No. 2007-307331, the content of which is incorporated herein by reference in its entirety.

BACKGROUND OF THE INVENTION

1. Field of the Invention

This invention relates to an LCD (Liquid Crystal Display) drive circuit that generates segment signals and common signals to turn LCD segments on and off.

2. Description of the Related Art

In general, a segment type LCD device has a plurality of LCD segments and performs a display by applying a common signal and a segment signal to each of the LCD segments. The common signal has a waveform that is a repetition of a certain waveform pattern. The segment signal corresponding to display data is generated with reference to the common signal, and turns the LCD segment on or off. An LCD drive circuit to drive the LCD device as described above is described in Japanese Patent Application Publication No. H07-3 19418, for example.

Some of the LCD drive circuits operate in two driving states that are a ¼ duty driving state and a ⅓ duty driving state. The driving states of the LCD drive circuit have been set as described below.

Serial data including display data is provided with additional two bits of identification data (DD0, DD1) and inputted as four steps of divided serial data in the case of the ¼ duty driving state or as three steps of divided serial data in the case of the ⅓ duty driving state. In the ¼ duty driving state, the four steps of serial data each identified by each of the identification data (DD0, DD1)=(0, 0), (0, 1), (1, 0) and (1, 1) are inputted, and a control bit DT in the first step of the serial data, which corresponds to the identification data (DD0, DD1)=(0, 0), is set to "0".

In the ⅓ duty driving state, on the other hand, the three steps of serial data each identified by each of the identification data (DD0, DD1)=(0, 0), (0, 1) and (1, 0) are inputted, and the control bit DT in the first step of the serial data, which corresponds to the identification data (DD0, DD1)=(0, 0), is set to "1".

The LCD drive circuit incorporates a power-down reset circuit that outputs a reset signal to initialize the circuit in a certain range of power supply voltage which is lower than an operating voltage. A meaningless display immediately after power-on is prevented by doing so. The reset state continues after the power supply voltage reaches the operating voltage properly, and is held until one of the driving states is set. After the serial data is properly inputted and its identification data is recognized, the reset state is released when inputting of the four identification data is confirmed in the case where the control bit DT is "0" or when inputting of the three identification data is confirmed in the case where the control bit DT is "1".

In the method to set the driving state described above, however, the driving state may be altered when a noise or the like causes an error in the control bit DT that solely determines the driving state. The altered driving state remains unchanged until the next first step of the serial data corresponding to the identification data (DD0, DD1)=(0, 0) is inputted properly. As a result, there is caused an abnormal display of the LCD segments. For example, all the four steps of serial data are inputted to operate in the ¼ duty driving state and the reset state is released. After that, if the control bit DT is mistakenly set to be "1" by a noise or the like when the first step of the serial data corresponding to the identification data (DD0, DD1)=(0, 0) is inputted, the driving state is altered to the ⅓ duty driving state and an unintended waveform of the signal is outputted.

Even when the control bit DT is not mistakenly changed, the conventional LCD drive circuit is structured so that the serial data corresponding to the other driving state can be inputted as long as its format is correct. For example, if the serial data corresponding to the ⅓ duty driving state is inputted while the LCD drive circuit is set to the ¼ duty driving state, there is caused a problem that an unintended display of the LCD segments is made based on the serial data.

SUMMARY OF THE INVENTION

This invention provides an LCD drive circuit having a serial data receiving circuit to receive serial data that includes display data and identification data to identify whether the serial data corresponds to a 1/n duty driving state or a 1/m duty driving state, an LCD drive signal generation circuit that generates a segment signal and a common signal to turn on or off an LCD segment based on the serial data received by the serial data receiving circuit and is switchable between the 1/n duty driving state and the 1/m duty driving state, and a driving state setting circuit that sets the LCD drive signal generation circuit to the 1/n duty driving state based on the identification data when the serial data receiving circuit receives the serial data corresponding to the 1/n duty driving state and forbids taking the serial data into the LCD drive signal generation circuit and forbids the LCD drive signal generation circuit from switching to the 1/m duty driving state based on the identification data when the serial data receiving circuit thereafter receives the serial data corresponding to the 1/m duty driving state.

DETAILED DESCRIPTION OF THE INVENTION

Figure 1:
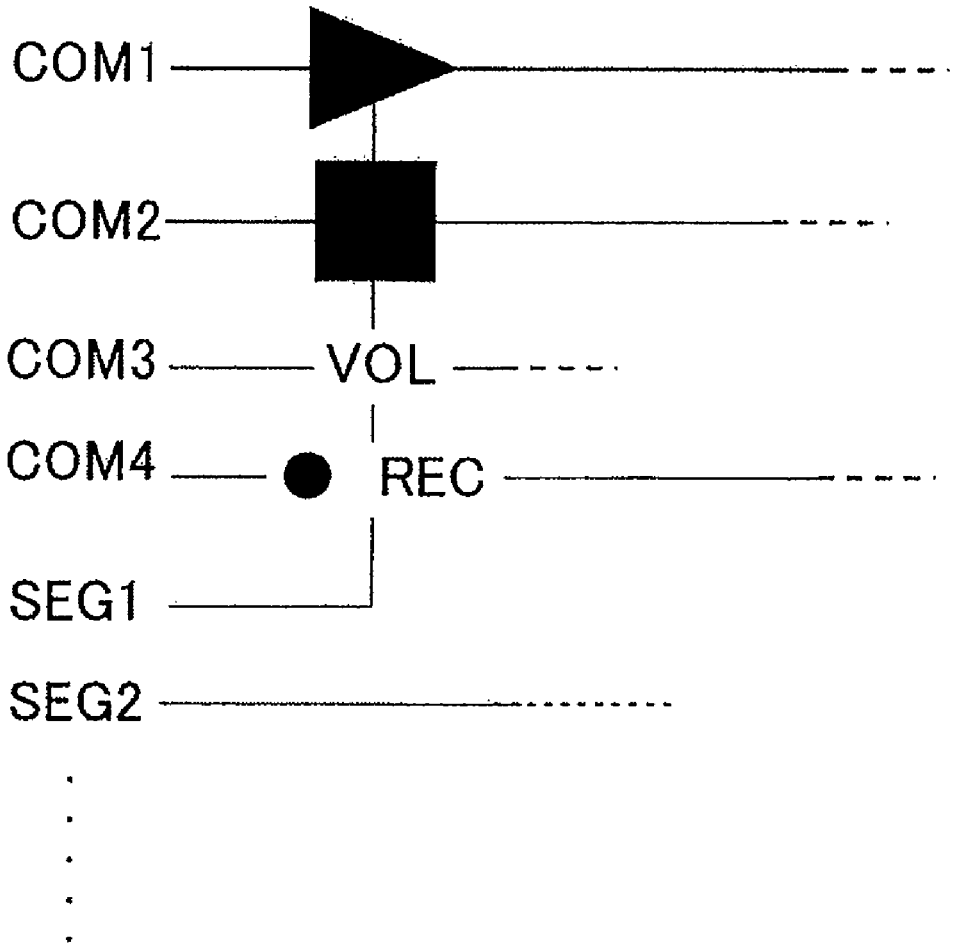
FIG. 1 shows LCD segments in a liquid crystal display device for an audio apparatus.

An LCD drive circuit according to an embodiment of this invention is described referring to the drawings. First, relationship between LCD segments and a driving state (a ¼ duty driving state, for example) is described. FIG. 1 shows the LCD segments in an LCD device for an audio apparatus. The LCD device has four LCD segments, to each of which each of common signals COM1-COM4 is applied, respectively. A segment signal SEG1 is applied to all the four LCD segments shown in the drawing. A segment signal SEG2 is applied to other LCD segments that are not shown in the drawing.

Figure 2:
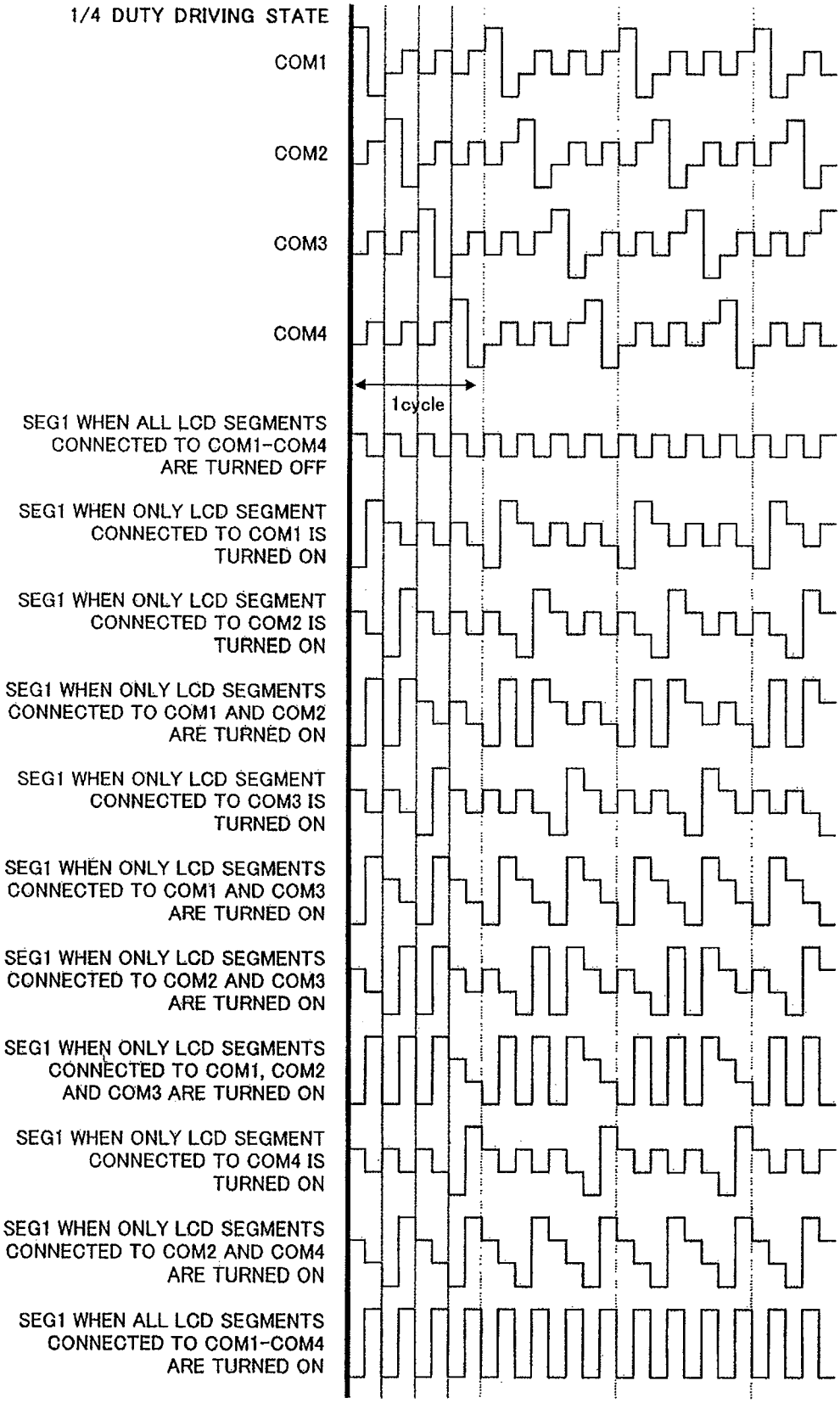
FIG. 2 shows waveforms of common signals and segment signals in a ¼ duty driving state.

FIG. 2 shows waveforms of the common signals COM1-COM4 and the segment signal SEG1. The four common signals COM1-COM4 are used in the ¼ duty driving state. The waveform of the common signal COM1 varies from an H level to an L level during the first ¼ of a period and alternates between two intermediate levels between the H level and the L level during remaining ¾ of the period. While the waveforms of the common signals COM2-COM4 are similar to the waveform of the common signal COM1, the common signal COM2 is delayed from the common signal COM1 by ¼ period, the common signal COM3 is delayed from the common signal COM2 by ¼ period, and the common signal COM4 is delayed from the common signal COM3 by ¼ period.

FIG. 2 also shows waveforms of the segment signal SEG1 below the waveforms of the common signals COM1-COM4. The segment signal SEG1 turns each of the segments on or off by varying its waveform every ¼ period corresponding to each of the common signals COM1-COM4. For example, in the case where all the LCD segments connected to the common signals COM1-COM4 are to be turned off, the waveform of the segment signal SEG1 alternates between the two intermediate levels during the period. In this case, all the LCD segments are turned off because an electric field applied across all the LCD segments does not exceed a threshold value.

In the case where the LCD segment connected to the common signal COM1 is to be turned on, the segment signal SEG1 varies from the L level to the H level during the first ¼ of the period. On the other hand, the common signal COM1 varies from the H level to the L level during the same ¼ of the period. That is, the segment signal SEG1 and the common signal COM1 are opposite in their phases during the ¼ period. As a result, an electric field exceeding the threshold value is applied across the LCD segment to turn on the LCD segment. FIG. 2 also shows the waveforms of the segment signal SEG1 in other cases.

As described above, the explanation is given regarding the ¼ duty driving state. In a ⅓ duty driving state, there are used three common signals. By varying a waveform of the segment signal correspondingly to each of the three common signals, corresponding each of the LCD segments can be turned on or off.

The LCD drive circuit according to the embodiment of this invention is switchable between the two driving states that are described above. To be more general, the driving states are a 1/n duty driving state and a 1/m duty driving state (n and m are natural numbers larger than one and different from each other.).

Figure 3:
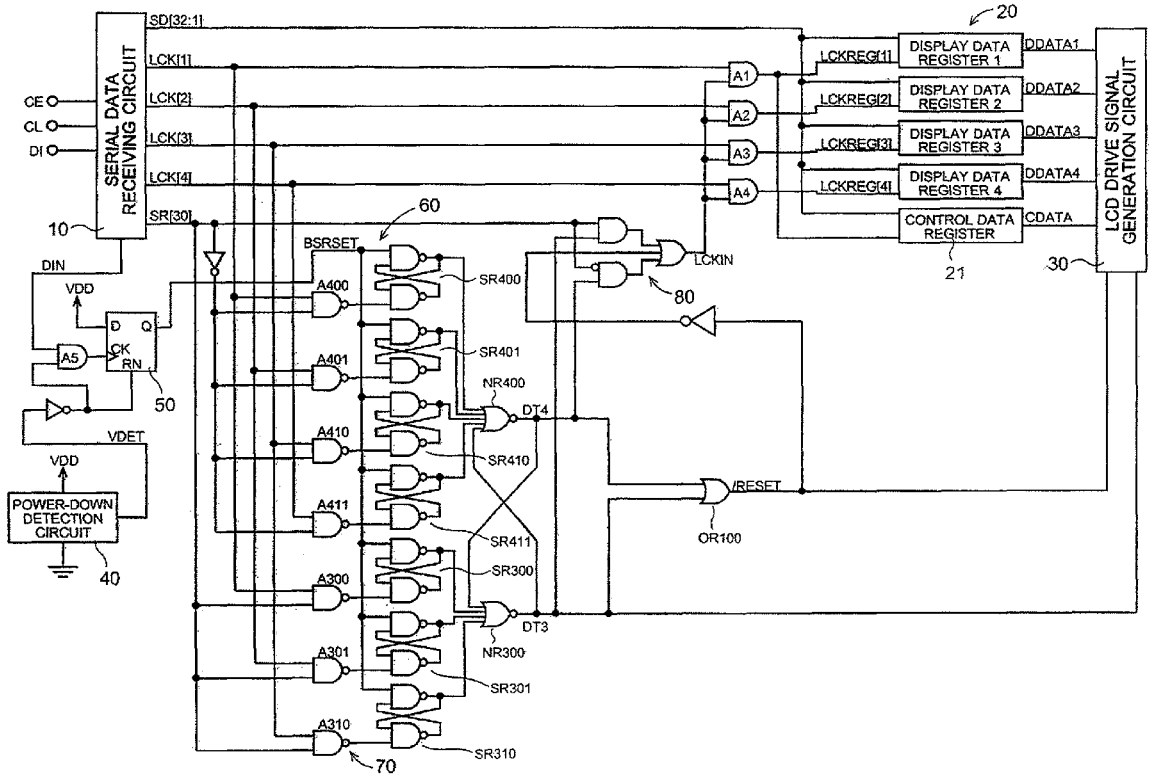
FIG. 3 shows a structure of an LCD drive circuit according to an embodiment of this invention.

A concrete structure of the LCD drive circuit according to the embodiment of this invention is described hereafter. FIG. 3 shows the structure of the LCD drive circuit. A serial data receiving circuit 10 receives serial data that includes address data, display data, identification data and control data. The serial data often becomes too long. Therefore, it is divided into several steps each with additional identification data when it is transmitted from a microcomputer or the like. In this embodiment, the serial data is divided into four steps in the case of the ¼ duty driving state, while it is divided into three steps in the case of the ⅓ duty driving state. The identification data is made of three bits and attached as last three bits of 32 bits of the serial data.

In the ¼ duty driving state, the identification data is (SR[30], SR[31], SR[32])=(0, 0, 0) in the first step, (SR[30], SR[31], SR[32])=(0, 0,1) in the second step, (SR[30], SR[31], SR[32])=(0, 1, 0) in the third step and (SR[30], SR[31], SR[32])=(0, 1, 1) in the fourth step. In the ⅓ duty driving state, the identification data is (SR[30], SR[31], SR[32])=(1, 0, 0) in the first step, (SR[30], SR[31], SR[32])=(1, 0, 1) in the second step and (SR[30], SR[31], SR[32])=(1, 1, 0) in the third step. That is, SR[30] is "0" in any step of the serial data in the ¼ duty driving state, while SR[30] is "1" in any step of the serial data in the ⅓ duty driving state.

The serial data receiving circuit 10 has a chip enable terminal CE through which a chip enable signal is inputted, a clock terminal CL through which a clock is inputted and a serial data input terminal DI through which the serial data transferred in synchronization with the clock is inputted.

After one step of the serial data is properly received by the serial data receiving circuit 10, it is transferred from the serial data receiving circuit 10 to a display data register 20 and a control data register 21. At that time, latch clocks LCK[1], LCK[2],LCK[3] and LCK[4] are sent out from the serial data receiving circuit 10 to the display data register 20 and the control data register 21 in accordance with the identification data attached to the serial data. The display data register 20 is composed of a display data register 1, a display data register 2, a display data register 3 and a display data register 4. The display data corresponding to each of the first through fourth steps of the serial data is configured to be taken into corresponding each of the four display data registers (the display data register 1, the display data register 2, the display data register 3 and the display data register 4) in the ¼ duty driving state, while the display data corresponding to each of the first through third steps of the serial data is taken into corresponding each of the three display data registers (the display data register 1, the display data register 2 and the display data register 3) in the ⅓ duty driving state. Since the control data, which is used to turn the LCD drive circuit into a sleep mode or to modify frequency of output signals generated in the LCD drive signal generation circuit 30, for example, is included in the first step of the serial data, it is taken into the control data register 21 based on the latch clock LCK[1].

An LCD drive signal generation circuit 30 generates the segment signals and the common signals to turn the LCD segments on or off based on the display data DDATA1-DDATA4 taken into the display data register 20 and the control data CDATA taken into the control data register 21.

The LCD drive circuit is also provided with a power-down detection circuit 40 that outputs a detection signal VDET of an H (high) level when the power supply voltage VDD is within a certain range. A latch circuit 50 that is reset by the detection signal VDET of the H level from the power-down detection circuit 40 and latches an output signal BSRSET of an L (low) level outputted from an output terminal Q of the latch circuit 50 is provided in a stage subsequent to the power-down detection circuit 40. A reverse signal of the detection signal VDET is applied to an reset terminal RN, an output signal of an AND circuit A5 is applied to an latch clock terminal CK, and the power supply voltage VDD is applied to a data input terminal D of the latch circuit 50. The latch circuit 50 is a flip-flop that can be set and reset. The reverse signal of the detection signal VDET is inputted to the AND circuit A5 together with an enable signal DIN (a signal which turns to the H level when the address in the serial data is verified) from the serial data receiving circuit 10.

A first reset control circuit 60 is provided with four SR latch circuits SR400, SR401, SR410 and SR411. Each of the SR latch circuits SR400, SR401, SR410 and SR411 is a flip-flop that can be set and reset. The output signal BSRSET from the latch circuit 50 is inputted to a first input terminal of each of the SR latch circuits SR400, SR401, SR410 and SR411. An output signal of each of NAND circuits A400, A401, A410 and A411 is inputted to a second input terminal of corresponding each of the SR latch circuits SR400, SR401, SR410 and SR411. Each of the latch clocks LCK[1] LCK[2], LCK[3] and LCK[4] is inputted to a first input terminal of corresponding each of the NAND circuits A400, A401, A410 and A411, while a reverse signal of the identification data SR[30] is inputted to a second input terminal of each of the NAND circuits A400, A401, A410 and A411. Output signals of the four SR latch circuits SR400, SR401, SR410 and SR411 and an output signal DT3 of a second reset control circuit 70 are inputted to a five-input NOR circuit NR400.

The second reset control circuit 70 is provided with three SR latch circuits SR300, SR301 and SR310. The output signal BSRSET from the latch circuit 50 is inputted to a first input terminal of each of the SR latch circuits SR300, SR301 and SR310. An output signal of each of NAND circuits A300, A301 and A310 is inputted to a second input terminal of corresponding each of the SR latch circuits SR300, SR301 and SR310. Each of the latch clocks LCK[1], LCK[2] and LCK[3] is inputted to a first input terminal of corresponding each of the NAND circuits A300, A301 and A310, while the identification data SR[30] is inputted to a second input terminal of each of the NAND circuits A300, A301 and A310. Output signals of the three SR latch circuits SR300, SR301 and SR310 and an output signal DT4 of the first reset control circuit 60 are inputted to a four-input NOR circuit NR300.

The output signal DT4 of the first reset control circuit 60 and the output signal DT3 of the second reset control circuit 70 are inputted to an OR circuit OR100. An output signal /RESET of the OR circuit OR100 is inputted as a reset signal to the LCD drive signal generation circuit 30. That is, the LCD drive signal generation circuit 30 is reset when the output signal /RESET of the OR circuit OR100 is at the L level, and is released from the reset state when the output signal /RESET is at the H level. The output signal DT3 of the second reset control circuit 70 is inputted to the LCD drive signal generation circuit 30 as a signal to determine the driving state. That is, the LCD drive signal generation circuit 30 is set to the ¼ duty driving state when the output signal DT3 is at the L level, and the LCD drive signal generation circuit 30 is set to the ⅓ duty driving state when the output signal DT3 is at the H level.

A data transfer control circuit 80 generates a transfer control signal LCKIN based on the identification data SR[30], the output signal DT4 of the first reset control circuit 60, the output signal DT3 of the second reset control circuit 70 and a reverse signal of the output signal /RESET of the OR circuit OR100.

The transfer control signal LCKIN is at the H level when the output signal /RESET of the OR circuit OR100 is at the L level (reset state). After the reset state is released and the output signal /RESET of the OR circuit OR100 is turned to the H level, the transfer control signal LCKIN turns to the H level only when the identification data SR[30] is "0" and the output signal DT4 is at the H level in the case where the ¼ duty driving state is set, and the transfer control signal LCKIN turns to the H level only when the identification data SR[30] is "1" and the output signal DT3 is at the H level in the case where the ⅓ duty driving state is set.

The transfer control signal LCKIN is inputted to each of four AND circuits A1-A4. Each of the latch clocks LCK[1], LCK[2], LCK[3] and LCK[4] is inputted to corresponding each of the four AND circuits A1-A4. An output signal LCKREG[1] of the AND circuit A1 is inputted to the display data register 1 and the control data register 21 as a latch clock, an output signal LCKREG[2] of the AND circuit A2 is inputted to the display data register 2 as a latch clock, an output signal LCKREG[3] of the AND circuit A3 is inputted to the display data register 3 as a latch clock, and an output signal LCKREG [4] of the AND circuit A4 is inputted to the display data register 4 as a latch clock.

Next, structures of the serial data receiving circuit 10 and the LCD drive signal generation circuit 30 are described in detail.

Figure 4:
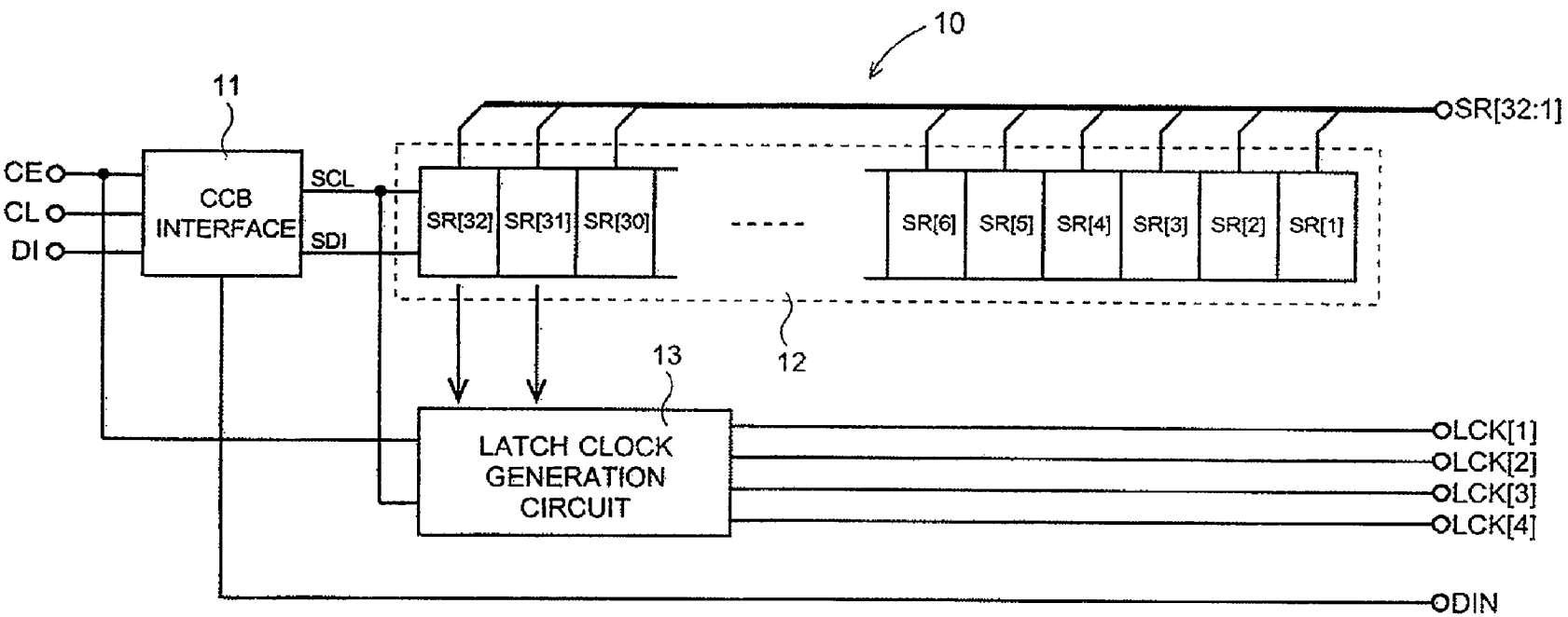
FIG. 4 shows a structure of a serial data receiving circuit.

FIG. 4 shows the structure of the serial data receiving circuit 10. The serial data receiving circuit 10 is provided with a CCB (Computer Control Bus) interface circuit 11 that verifies the address data in the serial data, a 32-bit shift register 12 that takes in the serial data inputted through the CCB interface circuit 11, and a latch clock generation circuit 13 that generates the latch clocks LCK[1], LCK[2], LCK[3] and LCK[4] based on two bits of the identification data SR[31] and SR[32] out of the three bits of the identification data SR[30], SR[31] and SR[32] taken into the shift register 12.

Figure 5:
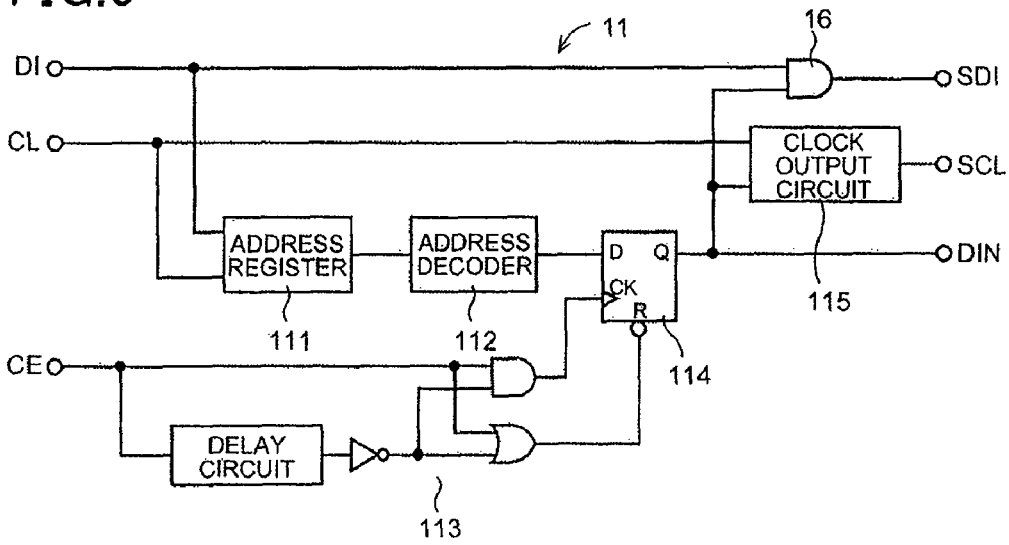
FIG. 5 shows a structure of a CCB interface circuit.

A structure of the CCB interface circuit 11 is shown in FIG. 5. The CCB interface circuit 11 is provided with an address register 111 that takes in the address data serially transferred from the microcomputer or the like in synchronization with the clock and temporarily stores it, an address decoder 112 that decodes the address data temporarily stored in the address register 111 to verify whether the address data coincides with a unique address pre-assigned to the LCD drive circuit and generates an address verify signal (H level when verified), a chip enable detection circuit 113 that detects a rise and a fall of the chip enable signal inputted through the chip enable terminal CE and an address verify signal register 114 that takes in and retains the address verify signal in synchronization with the rise of the chip enable signal and is reset in synchronization with the fall of the chip enable signal.

An output of the address verify signal register 114 is used as the enable signal DIN. The enable signal DIN is inputted to a clock output circuit 115 that receives the clock inputted through the clock terminal CL and to an AND circuit 16 that receives the serial data inputted through the serial data input terminal DI. When the enable signal DIN is at the H level, the clock is outputted from a terminal SCL through the clock output circuit 115 and the serial data is outputted from a terminal SDI through the AND circuit 16.

Figure 6:
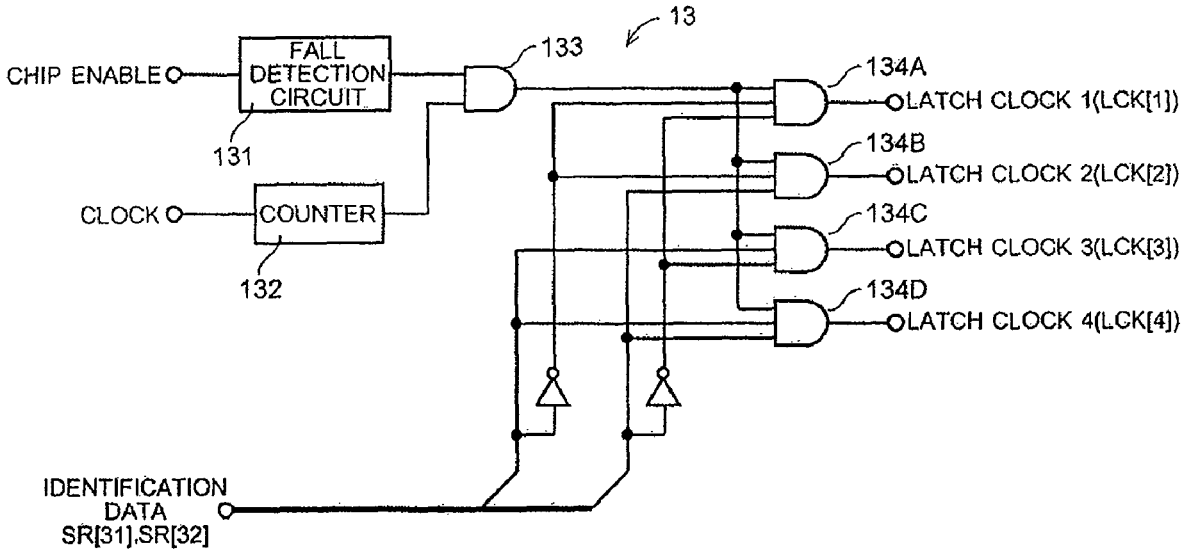
FIG. 6 shows a structure of a latch clock generation circuit.

A structure of the latch clock generation circuit 13 is shown in FIG. 6. The latch clock generation circuit 13 is provided with a fall detection circuit 131 that outputs an output signal of the H level when it detects a fall of the chip enable signal and a counter 132 that counts the number of clock pulses in the clock inputted through the clock terminal CL. Since the serial data is transferred in synchronization with the clock, the counter 132 can find a data length of the serial data that is inputted by counting the number of the clock pulses in the clock and outputs an output signal of the H level when it confirms that a predetermined data length of the serial data is inputted.

The output signal of the fall detection circuit 131 and the output signal of the counter 132 are inputted to an AND circuit 133. The latch clock generation circuit 13 is also provided with four AND circuits 134A-134D to which the two bits of the identification data SR[31] and SR[32] and their reverse data are inputted. An output signal of the AND circuit 133 is inputted to each of the four AND circuits 134A-134D.

Figure 7:
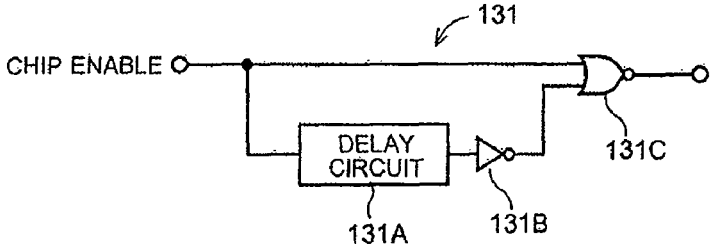
FIG. 7 shows a structure of a fall detection circuit.

The latch clock generation circuit 13 generates the latch clock LCK[1] when all of the first step of the serial data is taken into the shift register 12 and the fall of the chip enable signal is detected ((SR[31], SR[32])=(0, 0) in this case), generates the latch clock LCK[2] when all of the second step of the serial data is taken into the shift register 12 and the fall of the chip enable signal is detected ((SR[31], SR[32])=(0, 1) in this case), generates the latch clock LCK[3] when all of the third step of the serial data is taken into the shift register 12 and the fall of the chip enable signal is detected ((SR[31], SR[32])=(1, 0) in this case) and generates the latch clock LCK[4] when all of the fourth step of the serial data is taken into the shift register 12 and the fall of the chip enable signal is detected ((SR[31], SR[32])=(1, 1) in this case). The fall detection circuit 131 can be made of a delay circuit 131A, an inverter 131B and a NOR circuit 131C as shown in FIG. 7.

Figure 8:
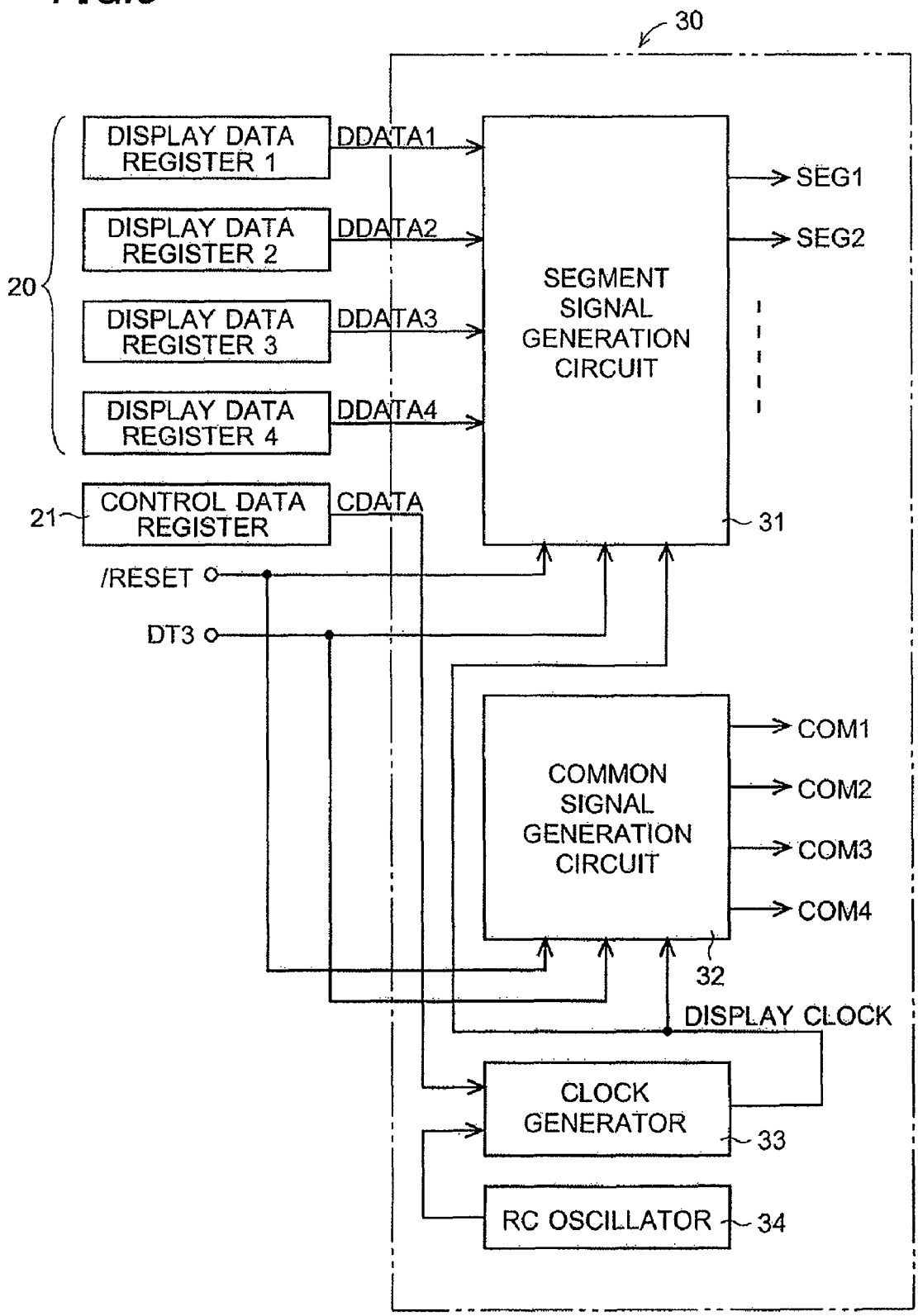
FIG. 8 shows a structure of an LCD drive signal generation circuit.
Figure 9A:
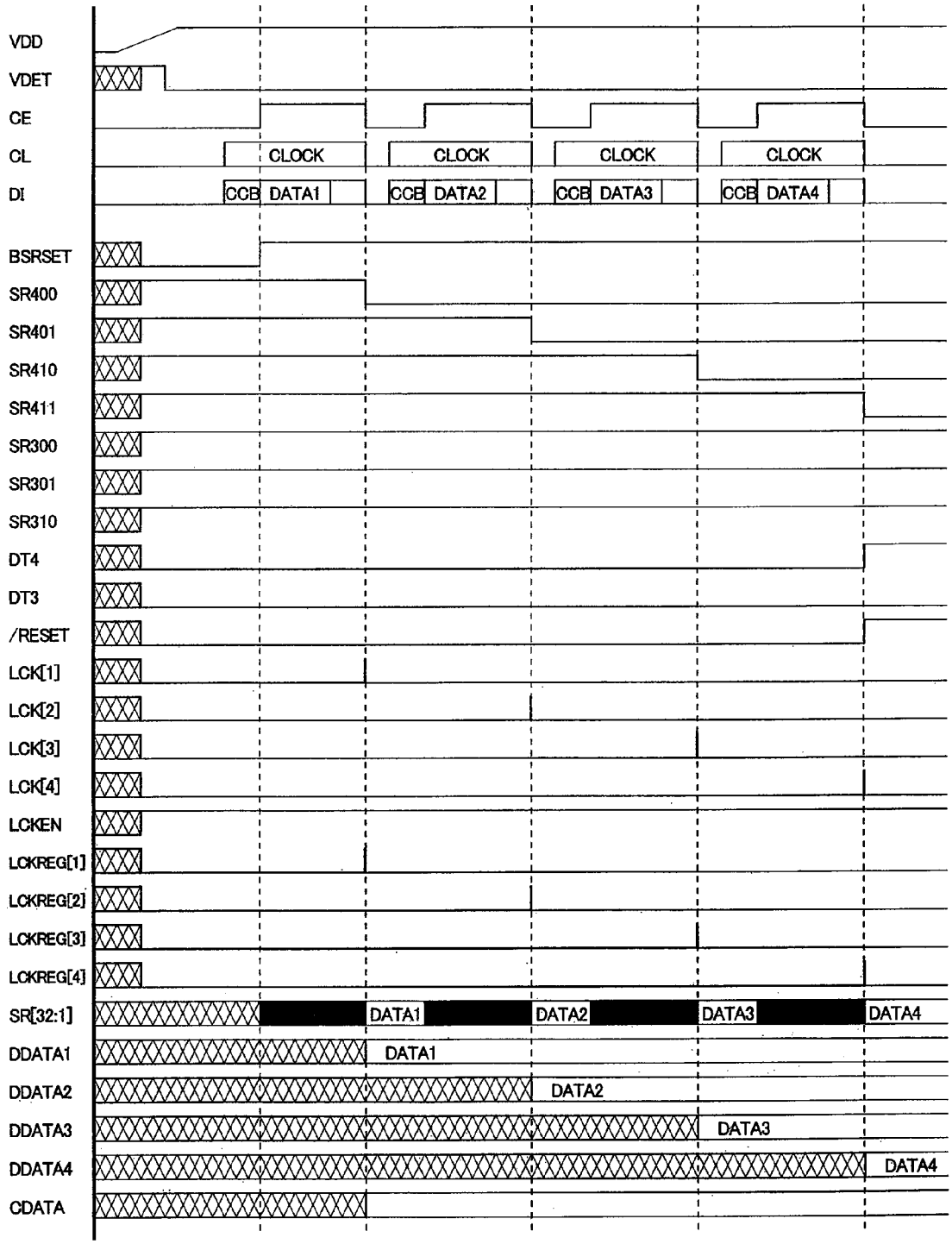
FIGS. 9A and 9B are timing charts showing operations of the LCD drive circuit according to the embodiment of this invention in the case where the LCD drive circuit is set to the ¼ duty driving state.
Figure 9B:
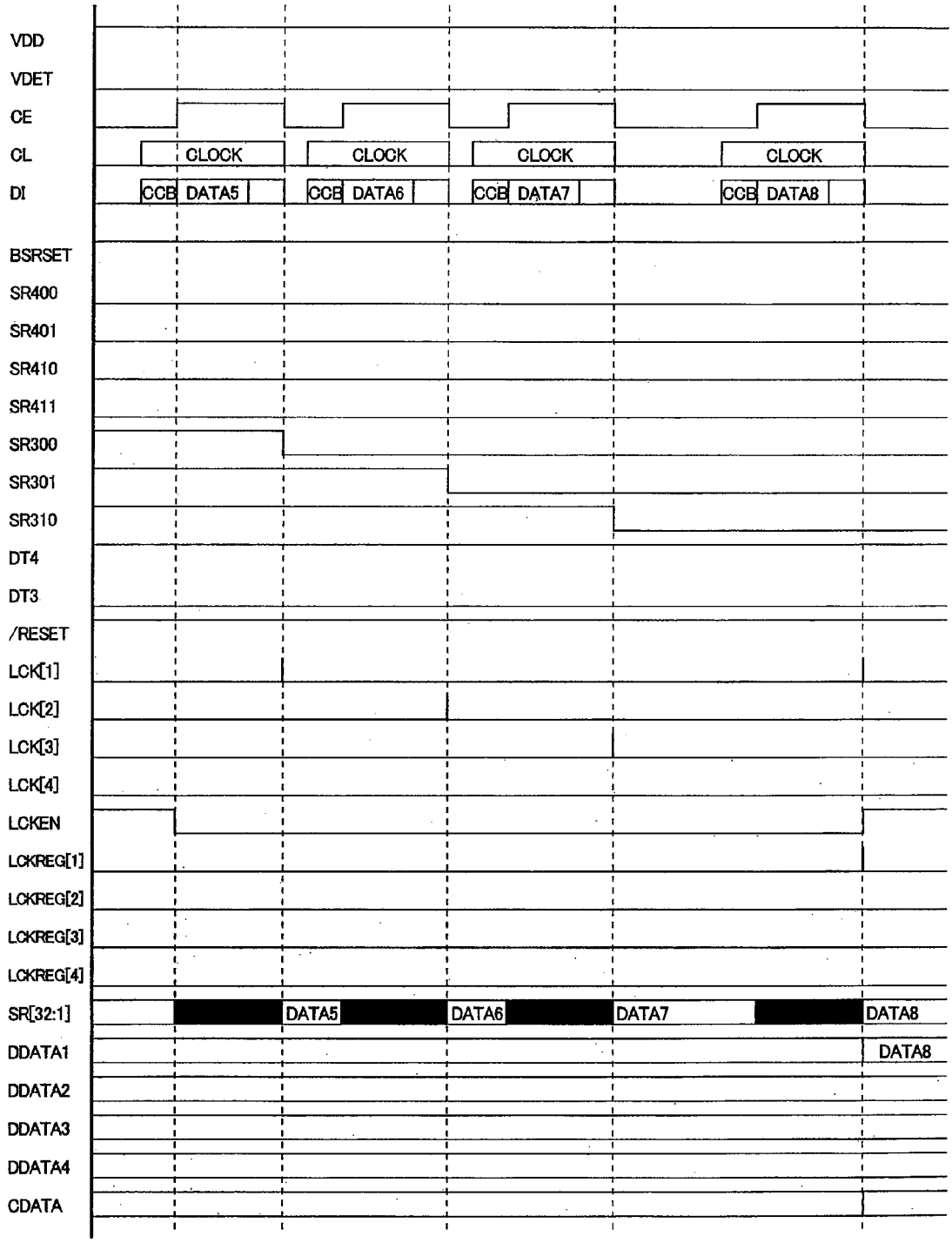

FIG. 8 shows the structure of the LCD drive signal generation circuit 30. The LCD drive signal generation circuit 30 is provided with a clock generator 33 that generates and controls a display clock so as to modify its frequency, for example, based on the control data CDATA taken into the control data register 21, an RC oscillator 34 that supplies a clock to the clock generator 33, a segment signal generation circuit 31 that generates the segment signals SEG1, SEG2, . . . to turn the LCD segments on or off based on the display clock, the display data DDATA1-DDATA4 taken into the display data register 20 and the output signal DT3 of the second reset control circuit 70, and a common signal generation circuit 32 that generates the common signals COM1-COM4 based on the display clock and the output signal DT3 of the second reset control circuit 70.

When the output signal DT3 of the second reset control circuit 70 is at the L level, the LCD drive signal generation circuit 30 is set to the ¼ duty driving state and generates the four common signals COM1-COM4 and corresponding waveforms of the segment signals SEG1, SEG2, . . . . When the output signal DT3 is at the H level, on the other hand, the LCD drive signal generation circuit 30 is set to the ⅓ duty driving state and generates the three common signals COM1-COM3 and corresponding waveforms of the segment signals SEG1, SEG2, . . . .

The output signal /RESET from the OR circuit OR100 is inputted to the segment signal generation circuit 31 and the common signal generation circuit 32. When the output signal /RESET is at the L level, the segment signal generation circuit 31 and the common signal generation circuit 32 are reset so that all of their output signals are held at the L level to turn off all the LCD segments.

Operations of the LCD drive circuit structured as described above will be explained referring to operational timing charts shown in FIGS. 9A, 9B, 10A and 10B.

[from Power-on to Reset State]

After the power is turned on, the power supply voltage VDD applied to the LCD drive circuit increases. In a certain range of the power supply voltage VDD along the way, the power-down detection circuit 40 outputs the detection signal VDET of the H level (an example of a power-on detection signal recited in claims of this application). The detection signal VDET of the H level resets the latch circuit 50 in the subsequent stage to turn the output signal BSRSET of the latch circuit 50 to the L level. As a result, the output of each of the SR latch circuits SR400, SR401, SR410 and SR411 in the first reset control circuit 60 and the output of each of the SR latch circuits SR300, SR01 and SR10 in the second reset control circuit 70 are turned to the H level. Both the output signal DT4 of the NOR circuit NR400 and the output signal DT3 of the NOR circuit NR300 are turned to the L level. Then, the output signal /RESET of the OR circuit OR100 is also turned to the L level. With this, the LCD drive signal generation circuit 30 is reset as the LCD drive circuit is placed in the reset state that is neither the ¼ duty driving state nor the ⅓ duty driving state. Thus, the LCD segments are prevented from making a display immediately after the power-on as described above. The reset signal is held until the serial data that determines the operation of the circuit is completely inputted.

[from Reset State to ¼ Duty Driving State]

Next, operations to set the ¼ duty driving state from the reset state will be explained referring to FIG. 3, FIG. 4 and FIGS. 9A and 9B. The four steps of serial data with the three bits of identification data (SR[30], SR[31], SR[32])=(0, 0, 0), (SR[30], SR[31], SR[32])=(0, 0, 1), (SR[30], SR[31], SR[32])=(0, 1, 0) and (SR[30], SR[31], SR[32])=(0, 1, 1), which correspond to the ¼ duty driving state, are inputted to the serial data receiving circuit 10 one after another.

When the first step of serial data corresponding to the identification data (SR[30], SR[31], SR[32])=(0, 0, 0) is inputted in the process, the address verification is performed in the CCB interface circuit 11, and the enable signal DIN is turned to the H level in synchronization with the rise of the chip enable signal when verified. Then the first step of the serial data is taken into the shift register 12 through the CCB interface circuit 11. And the latch circuit 50 takes in the H level of the power supply voltage VDD in response to the enable signal DIN and its output signal BSRSET is turned to the H level.

When the first step of the serial data is completely inputted to the shift register 12, the latch clock LCK[ 1] is generated in synchronization with the fall of the chip enable signal and the SR latch circuit SR400 outputs the L level based on it. After that, the second, third and fourth steps of the serial data are inputted to the serial data receiving circuit 10 one after another. Each of the SR latch circuits SR401, SR410 and SR411 outputs the L level one after another in synchronization with corresponding each of the latch clocks LCK[2], LCK[3] and LCK[4], and the NOR circuit NR400 outputs the output signal DT4 of the H level based on them. As a result, the output signal /RESET of the OR circuit OR1OO is turned to the H level and the LCD drive signal generation circuit 30 is released from the reset state.

Also, the data transfer control circuit 80 is set into a state in which its output signal LCKIN does not turn to the H level unless the identification data SR[30] is "0". In other words, unless the identification data SR[30] is "0", the output signal LCKIN remains at the L level so that the latch clocks LCK[1], LCK[2], LCK[3] and LCK[4] are not inputted to the display data register 20 or the control data register 21. Since the identification data SR[30] is "0"0 in this case, the output signal LCKIN is at the H level and the serial data is transferred to the display data register 20 and the control data register 21.

Since the output signal DT4 of the NOR circuit NR400 is also inputted to the NOR circuit NR300 in the second reset control circuit 70, the output signal DT3 of the NOR circuit NR300 is held at the L level. That is, the LCD drive signal generation circuit 30 is set in the ¼ duty driving state.

After the ¼ duty driving state is set, the LCD drive circuit is held in a state in which the serial data corresponding to the ⅓ duty driving state is not transferred to the display data register 20 or the control data register 21, until the detection signal VDET of the H level is outputted from the power-down detection circuit 40 to reset the circuits. Also, the ¼ duty driving state is never converted into the ⅓ duty driving state in the mean time.

[from Reset State to ⅓ Duty Driving State]

Figure 10A:
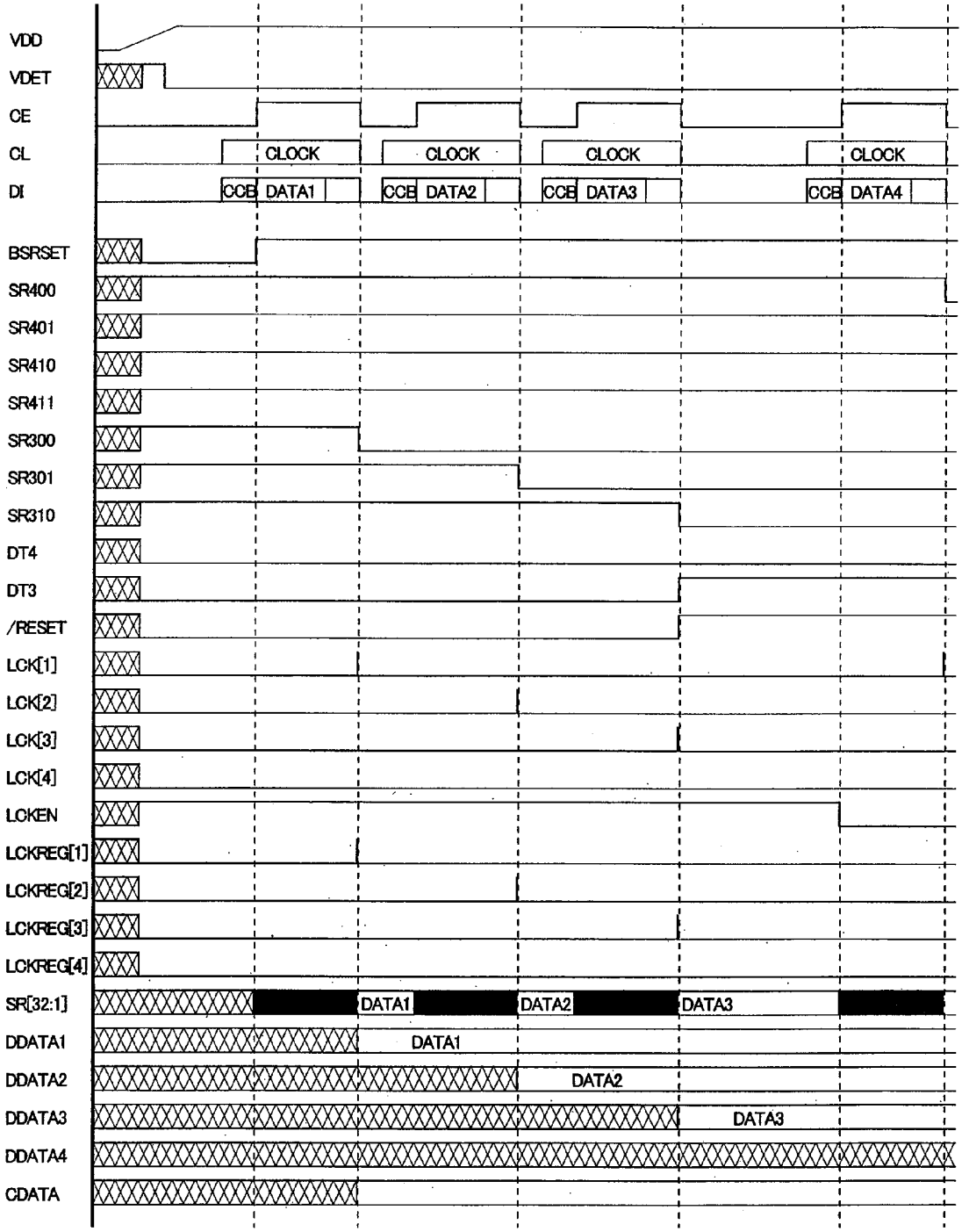
FIGS. 10A and 10B are timing charts showing operations of the LCD drive circuit according to the embodiment of this invention in the case where the LCD drive circuit is set to the ⅓ duty driving state.
Figure 10B:
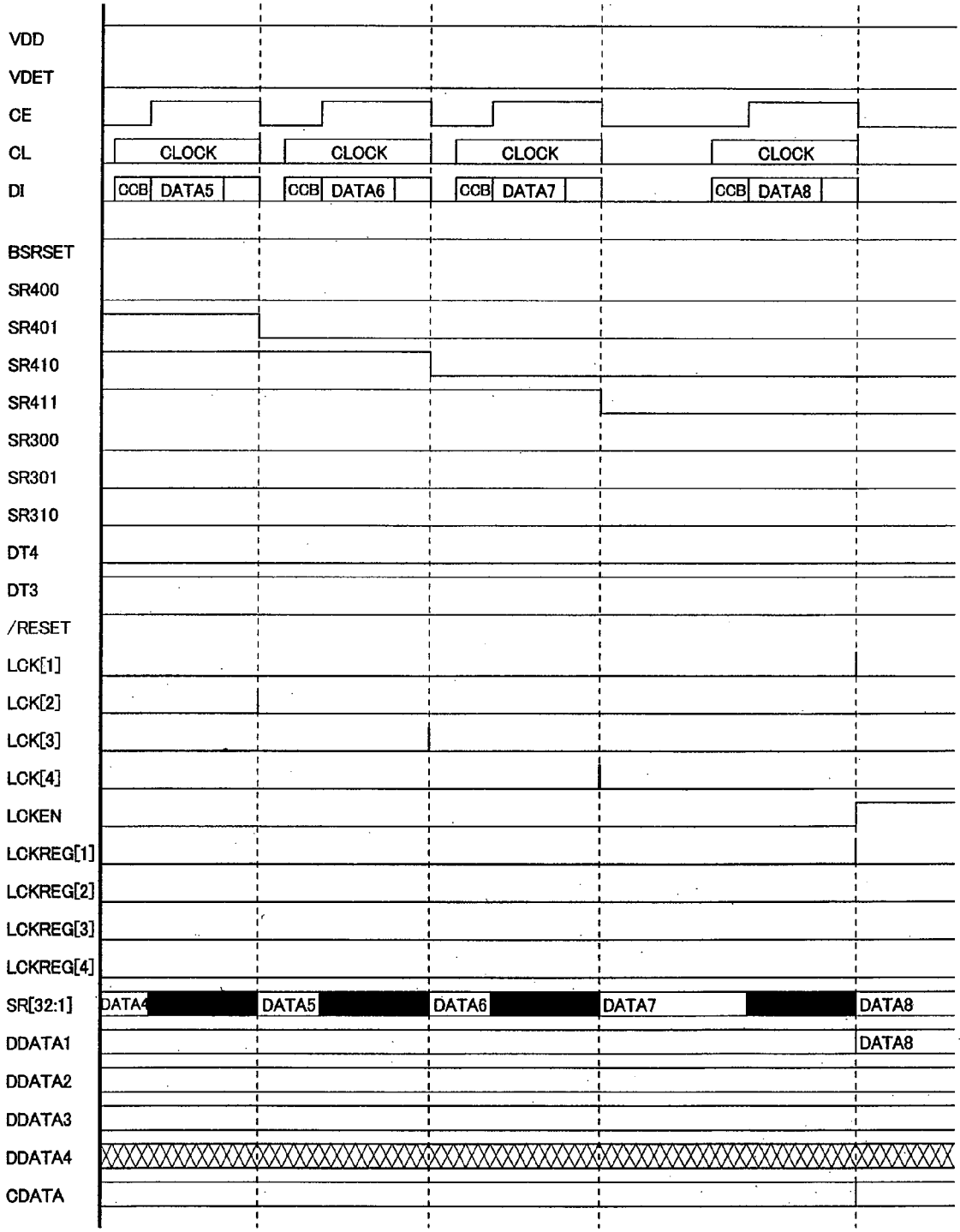

Next, operations to set the ⅓ duty driving state from the reset state will be explained referring to FIG. 3 and FIGS. 10A and 10B. Similar to the way described above, when the three steps of the serial data with the three bits of identification data (SR[30], SR[31], SR[32])=(1, 0, 0), (SR[30], SR[31], SR[32])=(1, 0, 1), and (SR[30], SR[31], SR[32])=(1, 1, 0), which correspond to the ⅓ duty driving state, are completely inputted to the serial data receiving circuit 10, each of the SR latch circuits SR300, SR301 and SR310 outputs the L level one after another in synchronization with corresponding each of the latch clocks LCK[1], LCK[2] and LCK[3], and the NOR circuit NR300 outputs the output signal DT3 of the H level based on them. As a result, the output signal /RESET of the OR circuit OR100 is turned to the H level and the LCD drive signal generation circuit 30 is released from the reset state. The address is verified by the CCB interface circuit 11.

Also, the data transfer control circuit 80 is set into a state in which its output signal LCKIN does not turned to the H level unless the identification data SR[30] is "1". In other words, unless the identification data SR[30] is "1", the output signal LCKIN remains at the L level so that the latch clocks LCK[1], LCK[2] and LCK[3] are not inputted to the display data register 20 or the control data register 21. Since the identification data SR[30] is "1" in this case, the output signal LCKIN is at the H level and the serial data is transferred to the display data register 20 and the control data register 21.

Since the output signal DT3 of the NOR circuit NR300 is also inputted to the NOR circuit NR400 in the first reset control circuit 60, the output signal DT4 of the NOR circuit NR400 is held at the L level. That is, the LCD drive signal generation circuit 30 is set in the ⅓ duty driving state.

After the ⅓ duty driving state is set, the LCD drive circuit is held in a state in which the serial data corresponding to the ¼ duty driving state is not transferred to the display data register 20 or the control data register 21, until the detection signal VDET of the H level is outputted from the power-down detection circuit 40 to reset the circuits. Also, the ⅓ duty driving state is never converted into the ¼ duty driving state in the mean time. To summarize the explanations described above, the first reset control circuit 60, the second reset control circuit 70, the data transfer control circuit 80, the AND circuits A1, A2, A3 and A4, and the OR circuit OR100 collectively set either of the two driving states that are the ¼ duty driving state and the ⅓ duty driving state, and thereafter forbid the serial data corresponding to another driving state from being transferred to the display data register 20 or the control data register 21 as well as forbidding the driving state from being converted to the another driving state based on the identification data SR[30] until the detection signal VDET of the H level is outputted from the power-down detection circuit 40 to reset the circuits.

Note that this invention is not limited to the embodiment described above and may be modified within the scope of the invention. For example, although the LCD drive circuit according to the embodiment of this invention is structured to be switchable between the two driving states that are the ⅓ duty driving state and the ¼ duty driving state, this invention may be applied to an LCD drive circuit switchable between a 1/n duty driving state and a 1/m duty driving state (n and m are natural numbers larger than one and different from each other.). Also, the number of bits of the serial data is not limited to 32.

With the LCD drive circuit according to the embodiment of this invention, the conversion to the wrong driving state can be prevented. It resolves the problem of unintended display that is caused by taking-in of the serial data corresponding to the driving state that is different from the driving state set in the LCD drive circuit.

What is claimed is:

1. An LCD drive circuit comprising:

a serial data receiving circuit configured to receive serial data that includes display data and first identification data to identify whether the display data corresponds to a 1/n duty driving state or a 1/m duty driving state;

an LCD drive signal generation circuit configured to generate a segment signal and a common signal to turn on or off an LCD segment based on the serial data received by the serial data receiving circuit, the LCD drive signal generation circuit being switchable between the 1/n duty driving state and the 1/m duty driving state; and a driving state setting circuit that sets the LCD drive signal generation circuit to the 1/n duty driving state based on the first identification data when the serial data receiving circuit receives the serial data corresponding to the 1/n duty driving state, thereafter forbids the serial data corresponding to the 1/m duty driving state from being taken into the LCD drive signal generation circuit based on the first identification data and forbids the LCD drive signal generation circuit from converting to the 1/m duty driving state;

wherein n and m are natural numbers larger than one and different from each other.

2. The LCD drive circuit of claim 1, wherein the serial data comprises a plurality of steps of serial data corresponding to the 1/n duty driving state or the 1/m duty driving state, the plurality of steps of serial data comprising second identification data different from each other.

3. The LCD drive circuit of claim 2, wherein the driving state setting circuit comprises a first reset control circuit that generates a first reset signal to set the LCD drive signal generation circuit to the reset state based on a power-on detection signal and thereafter generates a first reset release signal to release the LCD drive signal generation circuit from the reset state when the serial data receiving circuit completes receipt of the serial data corresponding to the 1/n duty driving state, and a second reset control circuit that generates a second reset signal to set the LCD drive signal generation circuit to the reset state based on the power-on detection signal and thereafter generates a second reset release signal to release the LCD drive signal generation circuit from the reset state when the serial data receiving circuit completes receipt of the serial data corresponding to the 1/m duty driving state.

4. The LCD drive circuit of claim 3, wherein the driving state setting circuit further comprises a data transfer control circuit that enables transfer of the serial data corresponding to the 1/n duty driving state to a data register based on the first identification data and the first reset release signal and enables transfer of the serial data corresponding to the 1/m duty driving state to the data register based on the first identification data and the second reset release signal.

5. The LCD drive circuit of claim 4, wherein the serial data receiving circuit comprises a shift register to take in the serial data and a latch clock generation circuit to generate a latch clock based on the second identification data included in the serial data taken into the shift register, and the data register takes in the display data based on the latch clock and an output of the data transfer control circuit.

6. The LCD drive circuit of claim 5, wherein the first reset control circuit comprises a first flip-flop that is reset based on the power-on detection signal and set by the latch clock and the first identification data corresponding to the 1/n duty driving state, and the second reset control circuit comprises a second flip-flop that is reset based on the power-on detection signal and set by the latch clock and the first identification data corresponding to the 1/m duty driving state.

7. The LCD drive circuit of claim 5, wherein the serial data receiving circuit comprises an interface circuit to verify address data included in the serial data and the shift register takes in the serial data based on a result of verification by the interface circuit.

8. The LCD drive circuit of claim 3, wherein the LCD drive signal generation circuit switches between the 1/n duty driving state and the 1/m duty driving state in response to an output of the second reset control circuit.

9. An LCD drive circuit comprising:

a serial data receiving circuit configured to receive serial data that includes display data and first identification data to identify whether the display data corresponds to a 1/n duty driving state or a 1/m duty driving state;

a data register to which the serial data received by the serial data receiving circuit is transferred;

an LCD drive signal generation circuit configured to generate a segment signal and a common signal to turn on or off an LCD segment based on the serial data transferred to the data register, the LCD drive signal generation circuit being switchable between the 1/n duty driving state and the 1/m duty driving state; and a driving state setting circuit that sets the LCD drive signal generation circuit in a reset state, transfers the serial data to the data register and releases the LCD drive signal generation circuit from the reset state, sets the LCD drive signal generation circuit in the 1/n duty driving state based on the first identification data when the serial data receiving circuit receives the serial data corresponding to the 1/n duty driving state, forbids the serial data corresponding to the 1/m duty driving state from being transferred to the data register based on the first identification data and forbids the LCD drive signal generation circuit from converting to the 1/m duty driving state after the reset state is released.

10. The LCD drive circuit of claim 9, wherein the serial data comprises a plurality of steps of serial data corresponding to the 1/n duty driving state or the 1/m duty driving state, the plurality of steps of serial data comprising second identification data different from each other.

11. The LCD drive circuit of claim 10, wherein the driving state setting circuit comprises a first reset control circuit that generates a first reset signal to set the LCD drive signal generation circuit to the reset state based on a power-on detection signal and thereafter generates a first reset release signal to release the LCD drive signal generation circuit from the reset state when the serial data receiving circuit completes receipt of the serial data corresponding to the 1/n duty driving state, and a second reset control circuit that generates a second reset signal to set the LCD drive signal generation circuit to the reset state based on the power-on detection signal and thereafter generates a second reset release signal to release the LCD drive signal generation circuit from the reset state when the serial data receiving circuit completes receipt of the serial data corresponding to the 1/m duty driving state.

12. The LCD drive circuit of claim 11, wherein the driving state setting circuit further comprises a data transfer control circuit that enables transfer of the serial data corresponding to the 1/n duty driving state to the data register based on the first identification data and the first reset release signal and enables transfer of the serial data corresponding to the 1/m duty driving state to the data register based on the first identification data and the second reset release signal.

13. The LCD drive circuit of claim 12, wherein the serial data receiving circuit comprises a shift register to take in the serial data and a latch clock generation circuit to generate a latch clock based on the second identification data included in the serial data taken into the shift register, and the data register takes in the display data based on the latch clock and an output of the data transfer control circuit.

14. The LCD drive circuit of claim 13, wherein the first reset control circuit comprises a first flip-flop that is reset based on the power-on detection signal and set by the latch clock and the first identification data corresponding to the 1/n duty driving state, and the second reset control circuit comprises a second flip-flop that is reset based on the power-on detection signal and set by the latch clock and the first identification data corresponding to the 1/m duty driving state.

15. The LCD drive circuit of claim 13, wherein the serial data receiving circuit comprises an interface circuit to verify address data included in the serial data and the shift register takes in the serial data based on a result of verification by the interface circuit.

16. The LCD drive circuit of claim 11, wherein the LCD drive signal generation circuit switches between the 1/n duty driving state and the 1/m duty driving state in response to an output of the second reset control circuit.

* * * * *